US006197484B1

(12) United States Patent
Kim et al.

(10) Patent No.: US 6,197,484 B1
(45) Date of Patent: Mar. 6, 2001

(54) METHOD OF MAKING A SINGLE PART COLOR PHOTOGRAPHIC PROCESSING COMPOSITION IN SLURRY FORM

(75) Inventors: Hongzoon Kim, Boonton; Hailing Duan, Ridgewood; Mani Philipose, New Milford, all of NJ (US)

(73) Assignee: Fuji Hunt Photographic Chemicals, Inc., Paramus, NJ (US)

( * ) Notice: Under 35 U.S.C. 154(b), the term of this patent shall be extended for 0 days.

(21) Appl. No.: 09/232,164

(22) Filed: Jan. 15, 1999

Related U.S. Application Data

(62) Division of application No. 09/037,966, filed on Mar. 11, 1998, now Pat. No. 5,914,221.

(51) Int. Cl.[7] ..... G03C 7/388
(52) U.S. Cl. ..... 430/450
(58) Field of Search ..... 430/450

(56) References Cited

U.S. PATENT DOCUMENTS

| | | | | |
|---|---|---|---|---|
| 2,735,774 | | 2/1956 | Henn | 430/453 |
| 2,784,086 | | 3/1957 | Henn | 430/466 |
| 3,607,277 | | 9/1971 | Schranz et al. . | |
| 5,006,438 | | 4/1991 | Ishikawa et al. . | |
| 5,869,226 | * | 2/1999 | Papai | 430/466 |

FOREIGN PATENT DOCUMENTS

| | | |
|---|---|---|
| 3106775 | 9/1982 | (DE) . |
| 3515440 | 4/1985 | (DE) . |
| 0204372 | 12/1986 | (EP) . |
| 0800111 | 4/1997 | (EP) . |
| 8-234389 | 9/1996 | (JP) . |
| WO81/02934 | 10/1981 | (WO) . |

OTHER PUBLICATIONS

Hoffmann et al, "Triphase Color Developer", *Trebla Chemical Company Presentation, IS& T's 10th International Symposium on Photofinishing Technology*, pp. 4–6, Feb. 1998.

* cited by examiner

*Primary Examiner*—Hoa Van Le
(74) *Attorney, Agent, or Firm*—Burns, Doane, Swecker, & Mathis, L.L.P.

(57) ABSTRACT

A homogeneous, single part slurry-form color photographic developer composition for use in color photographic processing is provided which comprises a defined compound of Formula (1) and, a p-phenylenediamine derivative, and contains a discontinuous solid phase distributed in a single liquid phase. The slurry is used by being completely dissolved in water, and diluted to make a working tank developer or developer replenisher solution, typically with a pH of about 10.4 or less for the working tank and 12.0 or less for the replenisher. The slurry is compact, homogeneous, easy to dispense, has excellent water solubility, and remains free of degradation during long-term storage. A process for developing photographic color silver halide photosensitive material with the slurry is also provided, as well as a process for making the slurry.

8 Claims, No Drawings

METHOD OF MAKING A SINGLE PART COLOR PHOTOGRAPHIC PROCESSING COMPOSITION IN SLURRY FORM

This application is a divisional of application Ser. No. 09/037,966, filed Mar. 11, 1998, now U.S. Pat. No. 5,914,221.

FIELD OF THE INVENTION

This invention relates to a homogeneous, single part, slurry-form color photographicdeveloper composition for use in color photographic processing, a process for developingcolor photographic positive emulsions with the slurry-form developer, and a process for making the slurry.

BACKGROUND OF THE INVENTION

Exposed photographic color silver halide positive emulsions are generally processed through the steps of color development, desilvering, washing, and stabilization, which usually uses the following processing solutions: color developer, bleaching solution, bleach-fixer, fixer, wash water, and stabilizing solution. These processing solutions are either prepared from solid chemicals, multi-part liquid concentrates, or diluted, single part ready to use solutions. Liquid concentrates however, lack compactness, may leak during transportation, handling, and storage; and may suffer from stability problems, especially in the case of a single part color developer. Solid chemicals can meet the requirement of compactness, and improved stability, and may take the form of a powder, tablet, or granule. Powders, however, frequently suffer from problems of dusting and caking. Although tableting and granulation have been proposed to eliminate these problems, these products frequently suffer from loss of ease of dissolution due to tablet or granule hardness resulting from the tableting and granulation process. Despite the advantage of compactness and stability, solid chemicals are often cumbersome to handle, and often require a lengthy dissolution step. Furthermore, single part solid color developers require special multi-layer granulation or coating processing or specialized layered packaging to isolate reactive materials such as alkali and p-phenylenediamine derivatives in order to retain stability which adds to the product's complexity and cost.

Various liquid, slurry, and paste-form single and multiple part photographic processing compositions have also been proposed. For example, Kleinschmidt in DE 3106775 discloses a single part liquid developer concentrate for color negative film comprising ethylene or higher glycols and a p-phenylenediamine derivative packaged in a sealed container to maintain its stability. JP 234389/1996 discloses a single part liquid developer concentrate for color emulsions containing diethylene glycol. The liquid concentrates of Kleinschmidt and JP 234389/1996 however suffer from the combined drawbacks of lack of stability requiring an air-tight, sealed container; and the need to use a significantly larger volume of liquid concentrate in comparison to a compact slurry to make the same amount working tank color developer or developer replenisher solution.

Dillon, et. al. in World Patent Application No. WO 8102934 discloses a homogeneous photographic processing concentrate comprising a discontinuous solid phase distributed in a continuous liquid phase, the solid phase comprising fine solid particles interlaced in the form of a stable three-dimensional reticulated structure imparting shear-rate thining, and the liquid phase containing benzyl alcohol and triethanolamine and being present in an amount smaller than the necessary amount to form a solution of the solid phase, but sufficient to impart flowability to the product. However a disadvantage of Dillon's disclosed composition however is the incompatiblility of the required benzyl alcohol with presently available color print emulsions.

Opladen in U.S. Pat. No. 3,607,277 discloses a fixer and bleach composition for processing color photographic materials in the form of a viscous paste having a viscosity between 300 and 2000 c.p.s. which serves to replace the respective liquid processing solutions. Conventional processing ingredients are combined with thickening agents which include polysaccharides, polyvinyl pyrrolidone, polyvinyl alcohol, and other water soluble polymers. Henn in U.S. Pat. No. 2,735,774 discloses a fixer concentrate having fixer components suspended in a water-soluble colloidal gel of alginate. Henn in U.S. Pat. No. 2,784,086 discloses a single part black and white developer concentrate comprising fine powdery hydroquinone and alkaline agents in a concentration of 0.5 to 10% in water and suspended as a concentrate paste in a colloidal gel of a compound selected from alginic acid, alginic acid salts, and alginic acid esters. Doesborgh in EP Patent Application 204372 discloses a two part black and white photographic developer concentrate in the form of a paste containing hydroquinone and either a water-soluble polymer or an organic water miscible solvent such as ethylene glycol or polyvinylpyrrolidone as a crystal growth inhibitor. Opladen, Henn, and Doesborgh do not however disclose a stable, single part color developer in the form of a homogenous slurry concentrate.

Hashimoto et. al., in European Patent Application EP 800111 discloses a low viscosity, pourable slurry-form, single-part, color photographic developer containing between 0.1 to 10% of a water soluble polymer and between 50 to 200% water based on the weight of the solid ingredients. It is reported that the slurry is easily transferred and readily dispersible. Furthermore, Hashimoto's slurry contains high quantities of alkali sufficient to solubilize p-phenylenediamine free base in a high water content medium and to make a developer replenisher of pH 12.0 or greater on dilution and dissolution of the slurry.

A heterogenous single part color developer concentrate is available from Trebla Chemical Company, as discussed at the IS&T's Tenth International Symposium on Photofinishing Technology (February, 1998; New Orleans, La.). This product is comprised of three distinct layers or phases: an aqueous lower phase containing inorganic salts, an upper phase containing the p-phenylenediamine developing agent dissolved in an organic solvent, and a middle phase consisting of an optical brightening agent suspended between the two layers. However, such heterogenous products are disadvantageous since the quality of the development process may decline due to an uneven dosage of color developer ingredients if only a portion of the container's contents are used or if any residue is allowed to remain in the container upon dispensing and mixing the product.

SUMMARY OF THE INVENTION

In accordance with the invention, a stable, homogenous, slurry-form, single-part color photographic composition ("slurry") is provided which is used to form either a working strength rapid access color print developer working tank solution or developer replenisher solution upon dilution and dissolution. As used herein, the inventive slurry is defined as a homogeneous, two-phase blend containing a discontinuous solid phase distributed in a continuous liquid phase, the solid phase comprising fine solid particles, and the liquid phase being present in an amount smaller than the necessary amount to form a true solution of the solid phase, but sufficient to impart flowability to the slurry. Importantly, the inventive slurry has sufficient stability to remain flowable by not hardening or caking with time, and to remain homogeneous by avoiding p-phenylenediamine oxidation and free base precipitation. Flowability in this context is defined as the ability for the slurry to be decanted or pumped from its container. The term homogeneous slurry is defined as a uniform appearing product which withstands phase separation for a minimum of 24 hours at 20–25° C. after preparation, and which can be easily redispersed and made homogeneous with mild agitation if settling later occurs.

The art has desired a slurry which provides a pH of under 12.0 after dilution to working or replenisher strength. Unfortunately, the p-phenylenediamine derivative tends to become more or less converted to insoluble derivatives which precipitate under such mild alkaline conditions. The inventive slurry avoids such precipitation problems.

Another feature of the present invention is the reduced water content, under about 50% w/w, which serves to enhance the slurry's storage stability, whereby color developer decomposition, precipitation, phase separation, and other unwanted reactions are avoided. Other features of the present invention include effective and rapid dissolution, compactness, ease of handling, and higher user productivity resulting from the use of the slurry composition. These and other features of the invention are attained by providing a slurry composition comprising:

a compound represented by the following Formula (1):

(I)

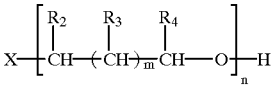

where X is selected from the group consisting of —$OR_1$, H and methyl; R, is selected from the group consisting of H, acyl, alkyl, alkenyl, aryl, and heteroaromatic, which is either unsubstituted or substituted; $R_2$ and $R_4$ can be the same or different and are selected from the group consisting of H, alkyl, alkenyl, aryl, and heteroaromatic, which is either unsubstituted or substituted; $R_3$ is selected from the group consisting of H, alkoxyl, alkyl, aryl, arylalkoxyl, aryloxycarbonyl, and alkoxycarbonyl, which is either unsubstituted or substituted; n is an integer from 1 to 5; m is 0 or 1;

a p-phenylenediamine derivative;

the slurry developer having a homogeneous two phase blend containing a discontinuous solid phase distributed in a single liquid phase, said solid phase comprising fine solid particles, and said liquid phase being present in an amount smaller tam the necessary amount to form a true solution of the solid phase, but sufficient to impart flowability to the slurry developer; and the slurry developer containing water in a concentration of less than about 50% (w/w).

Compounds according to formula (1) (also referred to as Compound I) are characterized by their ability to do the following:

1) prevent formation of insoluble p-phenylenediamine derivatives,
2) display substantial miscibility with water at a temperature range of 20 to 25° C. as evidenced by forming a clear solution, free from turbidity,
3) prevent the slurry developer from hardening or caking appreciably with time which would substantially diminish slurry flowability i.e. prevent decantation or make pumping impractical;
4) prevent the slurry developer from showing noticeable p-phenylenediamine derivative oxidation, and decomposition,
5) prevent deleterious photographic emulsion swelling,
6) show relatively little if any volatility under normal processing conditions, and
7) form a stable slurry-form single-part color developer when used in a concentration range of 0.1 to 80%, preferably 5.0 to 70%, and more preferably 5.0 to 50.0% (all percentages expressed as w/w) when blended with conventional solid color photographic developer constituents according to conditions described in the examples below.

The concentration of Compound I in this range ensures the formation of a stable slurry, with which photographic material can be satisfactorily processed. Less than 0.1% (w/w) of Compound I doesn't allow complete stabilization of the p-phenylenediamine developer in the slurry, whereas more than 80% (w/w) of Compound I allows for a very dilute slurry which is less economical to manufacture and use and has less of the advantages of compact size, and reduced shipping and packaging costs.

Preferably the slurry developer has the following characteristics:

It contains a p-phenylenediamine derivative, preferably 4-amino-3-methyl-N-ethyl-N-((beta)-(methanesulfonamido)ethyl)aniline or a salt thereof in a concentration range ofabout 6.5 to 16.0 mmoles/l in the case of a working tank developer or 11.0 to 37.0mmoles/l in the case of a developer replenisher after diluting and dissolving said slurry in water by a volume factor of 4 to 16;

a hydroxylamine preservative in a concentration range of about 2 to 10 g/l in the case of a working tank developer or 3.0 to 12.0 g/l in the case of a developer replenisher after diluting and dissolving said slurry in water by a volume factor of 4 to 16;

and the slurry provides a pH range of 9.1 to 10.4 in the case of a working tank developer or 10.0 to 12.0 in the case of a developer replenisher after diluting and dissolving said slurry in water by a volume factor of 4 to 16.

The molecular weight of Compound I is under 1000, preferably under 500. Additionally suitable optional substituents for the defined members of $R_1$, $R_2$, $R_3$, and R include the following: hydroxy, carboxy, alkoxy, acyl, alkoxycarbonyl, epoxy, amino, imino, amido, imido, oxime, ammonium, nitro, nitrilo, sulfonate, sulfinate, sulfonium, sulfide, thiol, thiocarboxy, thiocarbonyl, phosphate, phosphonate, phosphinate, and the like. The slurry contains water in a concentration of less than about 50% w/w. Preferred examples of Compound I include ethylene glycol, diethylene glycol, triethylene glycol, tetraethylene glycol, 1,2 propanediol, triethylene glycol monophenyl ether, and diethylene glycol monoethyl ether. Most preferred are ethylene glycol, and diethylene glycol. Optionally other organic solvents which are compatible with photographic development, are water miscible, and not within the definition of Compound I may be added to the slurry developer to aid in forming a homogenous slurry by adequately suspending the solid phase therein while replacing a portion of Compound I ("compatible water miscible solvent"). However, the developer must contain a minimum of 0. 1% (w/w) of Compound I. Photographic compatibility here means providing acceptable sensitometric performance and avoiding excessive emulsion swelling.

As indicated above, the slurry is used after being diluted and dissolved in water using a dilution factor of about 4 to 16 to form a working tank color development solution, or a developer replenisher. The replenisher is normally continually added to the working tank in the photographic processor to maintain developer effectiveness as the developer solution evaporates, becomes contaminated with emulsion extractives during processing, or becomes oxidized with continued use.

Another feature of the invention is to provide a method for processing an exposed silver halide photosensitive print material, comprising the steps of: mixing the slurry in water so that the particles of the solid phase are dissolved so as to form a processing solution; and processing the exposed photosensitive material with said processing solution. Such a process for developing exposed color photographic materials avoids the possibility of mixing errors inherent in using a conventional, multi-part, color photographic processing composition. In this process, the slurry may be either manually added by decanting into the processor developer tank at prescribed intervals, or it can be metered in based on the actual quantity of photographic material processed, or based on some measured property of the process bath such as: the specific gravity or pH of the working tank solution, the concentration of depleted components therein as determined by chemical analysis, the accumulation of decomposition products, the accumulation of extractives from the photographic material, or any combination of the foregoing and the like.

Another feature of the invention is to provide two processes for making the slurry the first of which comprises dispersing solid alkaline compounds and solid p-phenylenediamine derivatives into a compatible water miscible organic solvent which contains substantially no water, and blending Compound I into the solvent-alkali-p-phenylenediamine mixture. Compatible water miscible organic solvents are defined above. Substantially no water means a water content of less than about 5% (w/w) of the blend to which the p-phenylenediamine derivative is added.

Alternatively, a second process for making the slurry comprises dispersing solid alkaline compounds and solid p-phenylenediamine derivatives into Compound I which contains substantially no water, and optionally a compatible, water miscible organic solvent. Substantially no water in this context means a water content of less than about 10% (w/w) of the blend to which the p-phenylenediamine derivative is added.

Other developer components may be optionally added before, during, or after adding the p-phenylenediamine derivative and alkaline compounds to the compatible solvent or Compound I. The only limitation in this regard is that the total water content of the blend receiving the p-phenylenediamine derivative does not exceed about 5% (w/w) in the event that Compound I has not been added previous to the addition of the p-phenylenediamine derivative. However, the water content of the blend may be increased toabout 10% (w/w) if at least about 0.1% (w/w) of Compound I is present prior to the addition of the p-phenylenediamine derivative. Additionally, heat is generated at various stages during slurry preparation, and cooling may be optionally applied to control temperature.

Any solid alkaline compound which is useful in a color developer may be used. These include alkali metal hydroxides, alkali metal carbonates, and the like. Useful alkali hydroxides include lithium, sodium, and potassium hydroxide with sodium and potassium hydroxides being preferred. Useful alkali metal carbonates include lithium, sodium, and potassium carbonates, with potassium carbonate being preferred.

In order to make a useful slurry developer with the desired attributes, the order of addition of the developer components is very important. Preferred addition sequences confer to a greater degree the advantages of avoiding both p-phenylenediamine derivative precipitation, oxidation, and slurry caking. In one embodiment illustrated in example 4, the solid alkaline components are initially dispersed in Compound I. This is followed by the addition of other developer ingredients. The resulting slurry was compared to the product produced when water is added first and Compound I last using the same composition. Substantial p-phenylenediamine derivative precipitation resulted upon dilution with water.

DESCRIPTION OF THE PREFERRED EMBODIMENTS

In a slurry developer according to the present invention, p-phenylenediamine derivative and other photographic processing components are dispersed in Compound I in fine particulate form, and the water content is less than about 50% (w/w). The slurry developer is typically packaged in a container for transportation and storage purposes.

The inventive slurry in one embodiment is pourable, whereby it has sufficient fluidity to flow out of the container by decantation. Additionally, with respect to the preparation of the processing working solution itself, handling is simplified and productivity is high because the possibility of mixing error is substantially reduced. As compared with a ready-to-use solution, the slurry has significantly reduced volume and weight, contributing to savings in transportation and storage space. Since the container will also likely have a smaller volume, packaging materials can be reduced and advantages of economy, lower recycling burden, and enhanced environmental protection will be seen.

As compared with prior art slurry compositions, the inventive slurry in one embodiment is characterized by low viscosity, high solubility in water, and the elimination of the inconvenience of viscous or gummy matter adhering to photographic material, which is difficult to solubilize. These attributes ensure good quality in the photographic materials processed. Moreover, as compared with the prior art flowable compositions, the slurry in this embodiment of the invention is characterized by low viscosity and high flowability so that it is readily and substantially discharged from the container so that the remaining slurry left in the container interior is therefore minimized. The composition can thereby be dispensed accurately into a processing tank in order to minimize the variation of photographic quality caused by varying dosages, enabling the production of photographs of consistently high quality.

The slurry developer contains one or more components having the structure of Compound I which solubilizes the p-phenylenediamine derivative and inhibits the ionization of incompatible ingredients contained therein. Illustrative, non-limiting examples of Compound I are given below.

I-1

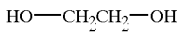

I-2

-continued

I-3

$HO-(CH_2-CH_2-O)_3-H$

I-4

$HO-(CH_2-CH_2-O)_4-H$

I-5

$H_3C-CH(OH)-CH_2-OH$

I-6

$H_3C-CH(OH)-CH_2-CH_2-OH$

I-7

$H_3C-O-(CH_2-CH_2-O)_2-H$

I-8

$H_3C-CH_2-O-CH_2-CH_2-O-H$

I-9

$CH_3-CH_2-CH_2-OH$

I-10

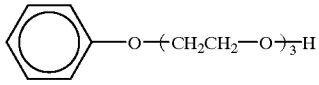

I-11

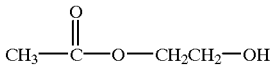

I-12

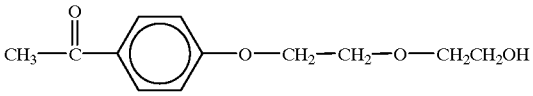

I-13

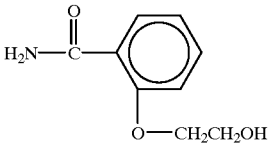

I-14

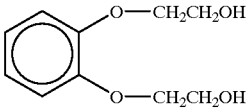

I-15

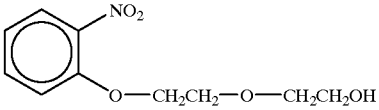

I-16

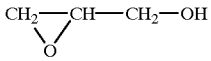

I-17

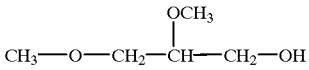

I-18

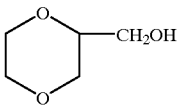

-continued

I-19

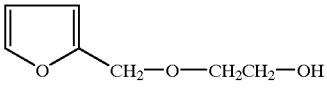

C-I

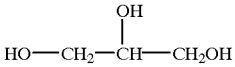

C-II $(HOCH_2CH_2)_3-N$

C-III

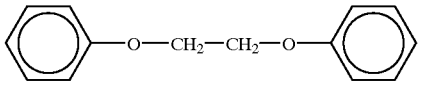

C-IV $CH_3CH_2O-CH_2CH_2-OCH_2CH_3$

Of the foregoing, it will be recognized that compounds C-I through C-IV are comparative compounds that are outside Formula (I).

In the slurry according to the invention, the solid phase photographic processing components are dispersed in fine particulate form. Fine particles may take any desired shape including spherical, needle and irregular shapes. They preferably have a mean particle size of up to 300 microns ($\mu$), more preferably up to 100$\mu$. With such a reduced size, the sedimentation tendency of fine particles in the slurry is lowered. With larger particle size, the sedimentation tendency would be higher, allowing for solidification. Although the lower limit of mean particle size is not critical, it is preferred to set a lower limit of about 0.01$\mu$ for two reasons. Such fine particles may form a hard sediment with time that resists redispersion with mild agitation. Furthermore, excess energy would be needed to attain finer particle sizes without any concomitant advantages of p-phenylenediamine derivative stability, etc. Therefore, fine particles preferably have a meanparticle size of about 0.01$\mu$ to 300$\mu$, more preferably about 0.1$\mu$ to 100$\mu$. In the case of needle particles, the mean particle size corresponds to a mean major axis length. The mean particle size or mean major axis length is determined by means of a scanning electron microscope (SEM). Except for needle particles, the mean particle size of non-spherical particles is calculated as a diameter of an equivalent circle obtained by projecting particles on a plane and converting the projected area into a circle.

The dispersing medium for the slurry is a combination of dispersing agents and optionally water. Water may be present as an aqueous solution in which some of photographic processing components are pre-dissolved. The concentration of water is preferably in the range of about 0 to 50% (w/w), preferably 0.2 to 25% (w/w). With a lesser amount of water, the slurry would have high viscosity but could still be conveniently pumped into a photographic processor. A slurry containing an excess of water reduces both the dispersion stability, and the ability of the p-phenylenediamine derivative to withstand alkali catalyzed decomposition. Similarly, alkali catalyzed decomposition will be evidenced by both precipitation and aerial oxidation of the p-phenylenediamine derivative. Useful dispersing agents can be chosen either individually or in combination from thegroups of anionic, nonionic, cationic, or zwitterionic surfactants. Useful dispersing agentsare described in the following references: Garrett, H. E. (1973), "Surface Active Chemicals", Pergamon Press, Oxford; Ash, M. and Ash, 1 (1981) "Encyclopedia of Surfactants", Chemical Publishing Co., New York; Surfactant Science Series, in 40 volumes, Marcel Dekker, Inc., New York; Flick, Ernest W. (1988) "Industrial Surfactants" Noyes Publishing, Park Ridge, N. J.; Stache, Helmut, Editor (1981) "Surfactant Handbook" 2n Ed., Carl Hanser, Verlag, Munich, Germany. Preferred dispersing agents include polynaphthalene sulfonates, nonylphenoxypolyglycidols, polysiloxanes, polyoxyethylene derivatives, polystyrene sulfonate/maleic acid copolymers, cellulosic derivatives, and polyvinylpyrrolidone. Most preferred are polysiloxanes, nonylphenoxypolyglycidols, polynaphthalene sulfonates, and polyvinylpyrrolidone.

As discussed above, the slurry according to the invention is characterized by fine solid particles uniformly dispersed in the slurry. In the slurry according to the invention, the p-phenylenediamine developer to be dispersed in fine particulate form includes, for example, developing agents such as 2-methyl4-(ethyl-N-((beta)-hydroxyethyl)amino) aniline hydrogen sulfate. Also included in the slurry are hydroxylamine derivatives such as disodium N,N-bis (sulfonatoethyl)hydroxylamine or a salt thereof. Optionally liquid form hydroxylamine derivatives may be used such as diethylhydroxylamine. Other particulate components are triazinyldiaminostilbene brighteners in color developers for color paper, which are commercially available as Hakkol FWA-SF by Showa Chemicals K.K., UVITEX CK, and Tinapol SFP by Ciba Geigy, Blankophor REU by Bayer, and WHITEXS by Sumitomo Chemicals K.K. These brighteners are of irregular shape and have a mean particle size of about 20 to 50 ($\mu$).

The slurry according to the invention is prepared, for example, by admitting solid photographic processing components according to the order described above, into a kneader or dispersing machine such as a Silverson model L4RTA high shear laboratory mixer equipped with a standard Emulsor screen with medium perforations (available from Silverson Machines Inc. (East Longmeadow, Mass.), a Charles Ross and Sons model ME100LX homogenizer, a twin-arm open kneader, a planetary high shear mixer, a continuous kneader, or a Henschel mixer and the like, where they are pulverized and mixed. Optionally, a small quantity of water is finally added, not in excess of about 50% (w/w), and pulverizing or blending is continued until a uniform slurry is obtained. The slurry is then gradually diluted with additional quantities of either water (not in excess of 50% w/w), a compatible water miscible organic solvent, Compound I, or some combination thereof, until a uniform slurry is obtained with the desired viscosity. The slurry is compact in that its volume corresponds to 6 to 30% of the volume of ready-to-use solution and 10 to 50% of the volume of currently available concentrates.

For packaging the slurry, conventional containers may be used, for example, polyethylene and other plastic bottles having an interior volume of about 0.5 to 5 liters. On use, the slurry composition of the invention is diluted with water by a factor of about 4 to 16. preferably about 5 to 10 in volume to form a ready-to-use solution. As a result of such dilution, the abovementioned photographic processing components which have been present as fine particles or solvated species in the dispersed phase of the slurry dissolve to form a homogeneous, clear solution which is free from turbidity.

The slurry contains p-phenylenediamine derivatives as color developing agents such as are described in U.S. Pat. Nos. 2,552,241 and 2,566,271; which are incorporated herein by reference. Typical examples include the following:

N,N-diethyl-p-phenylenediamine,
2-amino-5-diethylaminotoluene,
2-amino-5-(N-ethyl-N-laurylamino)toluene,
4-(N-ethyl-N-((beta)-hydroxyethyl)amino)aniline,
2-methyl-4-(N-ethyl-N-((beta)-hydroxyethyl)amino) aniline,
2-methyl-4-(N-ethyl-N-((beta)-hydroxybutyl)amino) aniline,
4-amino-3-methyl-N-ethyl-N-((beta)-(methanesulfonamido)ethyl)aniline,
N-(2-amino-5-diethylaminophenylethyl) methanesulfonamide,
N,N-dimethyl-p-phenylenediamine,
4-amino-3-methyl-N-ethyl-N-methoxyethylaniline,
4-amino-3-methyl-N-ethyl-N-(beta)-ethoxyethylaniline, and
4-amino-3-methyl-N-ethyl-N-(beta)-butoxyethylaniline.

Especially preferred are:

4-amino-3-methyl-N-ethyl-N-((beta)-(methanesulfonamido)ethyl)aniline and
4-(N-ethyl-N-((beta)-hydroxyethyl)amino)aniline.

These p-phenylenediamine derivatives may also be salts of sulfuric acid, hydrochloric acid, sulfurous acid, and p-toluenesulfonic acid. These compounds may be used in admixture of two or more if desired.

From the standpoints of preventing slurry sedimentation, p-phenylenediamine free base precipitation, and preventing a variation of photographic properties from occurring causing a variation of the quantity of photosensitive material being processed, it is preferred that the color developer and color developer replenisher contain a compound of the following general formula (H) as a preservative. In formula (H), $R_5$ and $R_6$ each are a hydrogen atom, substituted or unsubstituted alkyl group, substituted or unsubstituted alkenyl group, substituted or unsubstituted aryl group or heteroaromatic group. It is excluded that both $R_5$ and $R_6$ are hydrogen atoms at the same time. Alternatively, $R_5$ and $R_6$, taken together, form a heterocyclic ring with the nitrogen atom. The heterocyclic structure is typically a 5- or 6-membered ring which is constructed by carbon, hydrogen, halogen, oxygen, nitrogen and/or sulfur atoms and may be either saturated or unsaturated. Most often, $R_5$ and $R_6$ are alkyl or alkenyl groups, preferably having 1 to 10 carbon atoms, most preferably 1 to 5 carbon atoms. The nitrogenous heterocyclic rings formed by $R_5$ and $R_6$, taken together, include piperidyl, pyrrolidinyl, N-alkylpiperazyl, morpholyl, indolinyl, and benzotriazole groups. Illustrative, non-limiting, examples of the compound of formula (H) are given below.

H

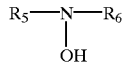

H-1

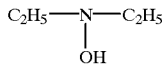

H-2

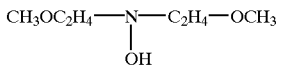

H-3

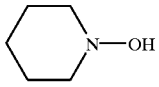

-continued

H-4

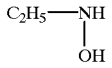

H-5

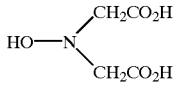

H-6

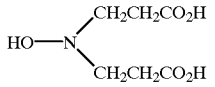

H-7

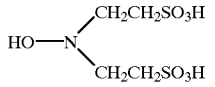

H-8

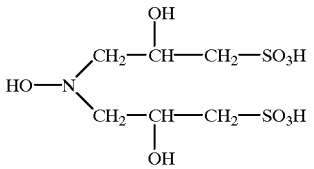

H-9

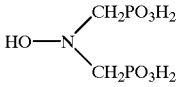

H-10

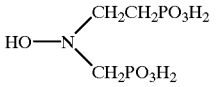

H-11

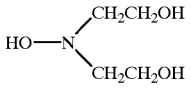

H-12

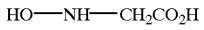

H-13

H-14

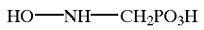

H-15

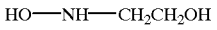

H-16

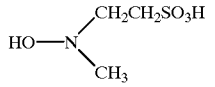

H-17

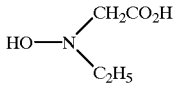

H-18

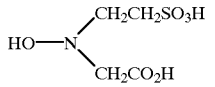

-continued

H-19

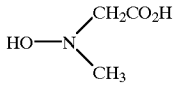

H-20

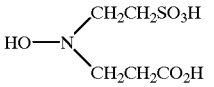

The compounds of formula (H) may be used alone or in an admixture of two or more. These compounds are preferably added to the color developer working solution and color developerreplenisher in an amount of 0.005 to 0.5 mol/liter, more preferably 0.03 to 0.1 mol/liter. In the practice of the invention, other organic preservatives may be added to the color developer working solution and color developer replenisher in addition to the compound of formula (H).

The term organic preservative is used to encompass all organic compounds which when added to processing solutions for color photographic photosensitive materials, function to inhibit degradation of the p-phenylenediamine derivatives, specifically preventing oxidation of p-phenylenediamine derivatives by air (aerial oxidation). Especially effective organic preservatives are hydroxamic acids, hydrazines, hydrazides, phenols, (alpha)-hydroxyketones, (alpha)-aminoketones, saccharides, monoamines, diamines, polyamines, quaternary ammonium salts, nitrosyl radicals, alcohols, oximes, diamides, and fused ring type amines. These preservatives are disclosed in U.S. Pat. Nos. 2,494,903; 3,615,503; 4,155,764; 4,801,521; and 5,063,142 all incorporated herein by reference. Other useful preservatives are metals as disclosed in USP 4,330,616, salicylic acids as disclosed in JP-A 180588/1984, amines as disclosed in U.S. Pat. Nos. 4,798,783; and 5,250,396 all incorporated herein by reference; alkanolamines as disclosed in U.S. Pat. No. 4,170,478 incorporated herein by reference; polyethylene imines as disclosed in U.S. Pat. No. 4,252,892 incorporated herein by reference; and aromatic polyhydroxy compounds as disclosed in U.S. Pat. No. 3,746,544 incorporated herein by reference. The addition of alkanolamines such as hydroxylamine N,N'diethanesulfonic acid is especially preferred.

In the practice of the invention, the addition of aromatic polyhydroxy compounds to the developer is preferred for improving the stability thereof. The aromatic polyhydroxy compounds are generally compounds having two hydroxyl groups on an aromatic ring at relative ortho-positions. Preferred aromatic polyhydroxy compounds are compounds having at least two hydroxyl groups on an aromatic ring at relative ortho-positions and free of unsaturation outside the ring. Included in a wide range of aromatic polyhydroxy compounds which can be used herein are benzene and naphthalene compounds. Examples to of the aromatic polyhydroxy compound which can be used herein are given below.

N-1 pyrocatechol
N-2 4,5-dihydroxy-m-benzene-1,3-disulfonic acid
N-3 disodium 4,5-dihydroxy-m-benzene-1,3-disulfonate
N-4 tetrabromopyrocatechol
N-5 pyrogallol
N-6 sodium 5,6-dihydroxy-1,2,4-benzenetrisulfonate
N-7 gallic acid
N-8 methyl gallate
N-9 propyl gallate
N-10 2,3-dihydroxynaphthalene-6-sulfonic acid
N-11 2,3,8-trihydroxynaphthalene-6-sulfonic acid.

These compounds may be used alone or in admixture of two or more. They may be added to the color developer working solution or color developer replenisher in an amount of 0.00005 to 0.1 mol/liter, usually 0.0002 to 0.04 mol/liter, preferably 0.0002 to 0.004 mol/liter of the developer.

The color developer working solution is preferably adjusted to pH 9 to 12.0, more preferably pH 9.5 to 10.3. The color developer replenisher is preferably adjusted to pH 10.3 to 12.0, more preferably pH 10.4 to 11.3. To maintain such pH, buffer agents are preferably used. Exemplary buffer agents include carbonate salts, phosphate salts, borate salts, tetraborate salts, hydroxybenzoate salts, glycyl salts, N,N-dimethylglycine salts, leucine salts, norleucine salts, guanine salts, 3,4-dihydroxyphenylalanine salts, alanine salts, aminobutyrate salts, 2-amino-2-methyl-1,3-propane diol salts, valine salts, proline salts, trihydroxyaminomethane salts, and lysine salts. In particular, carbonate salts, phosphate salts, tetraborate salts, and hydroxybenzoate salts are preferred buffer agents because these salts possess many advantages including improved solubility, buffering ability in a high pH region of pH 9.0 or higher, no adverse photographic effects such as fog on photographic performance when added to color developers, and low cost.

Illustrative examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The buffer agent is preferably added to the color developer working solution or color developer replenisher in an amount of at least 0.1 mol/liter, more preferably 0.1 to 0.4 mol/liter.

In the color developer, various chelating agents may be used as an agent for preventing calcium and magnesium from precipitating and for improving the stability of the developer. Exemplary chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diamine tetraacetic acid, ethylenediamine orthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and hydroxyethyliminodiacetic acid. These chelating agents may beused alone or in admixture of two or more. The amount of the chelating agent added shouldbe sufficient to complex metal ions in the color developer, and is generally 0.1 to 10 grams/liter.

In the color developer, a development accelerator may be added if necessary. Useful development accelerators include thioether compounds as described in JP-B 16088/1962, 5987/1962, 7826/1963, 12380/1969, 9015/1970, and U.S. Pat. No. 3,318,247 incorporated herein by reference; p-phenylenediamine derivatives as described in JP-A 49829/1977 and 15554/1975; quaternary ammonium salts as described in JP-A 137726/1975, 156826/1982, 43429/1977 and JP-B 30074/1969; amine compounds as described in U.S. Pat. Nos. 2,494,903, 3,128,182, 4,230,796, 3,253,919, 2,482,546, 2,596,926, 3,582,346 and JP-B 11431/1966; polyalkylene oxides as described in JP-B 16088/1962, 25201/1967, 11431/1966, 23883/1967, U.S. Pat. Nos. 3,128,183 and 3,532,501 all incorporated herein by reference; and 1-phenyl-3-pyrazolidones and imidazoles.

Optionally one or more antifoggants may be is added to the developer. Exemplary antifoggants include alkali halides such as sodium chloride, potassium bromide, and potassium iodide, and organic antifoggants as typified by nitrogenous heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, and adenine.

In the practice of the invention, the color developer working solution is preferably adjusted to a chloride ion concentration of 0.05 to 0.2 mol/liter, more preferably 0.06 to 0.15 mol/liter, most preferably 0.08 to 0.13 mol/liter for preventing an unwanted variation of photographic properties. Also, the color developer working solution is preferably adjusted to a bromide ion concentration of 0.0001 to 0.0004 mol/liter, more preferably 0.00012 to 0.00038 mol/liter, most preferably 0.00015 to 0.00035 mol/liter for preventing a variation of photographic properties. Most preferably chloride and bromide ions are combined in the above-defined concentrations.

One or more fluorescent brightening agents can also be added the color developer working solution and color developer replenisher, if necessary. Preferred brighteners are 4,4'-diamino-2,2'-disulfostilbene compounds. Compounds of the following general formula (SR) are preferred because of their solubility in replenisher solution, improved solubility of slurry processing composition, and reduced stain of processed photosensitive material.

(SR)

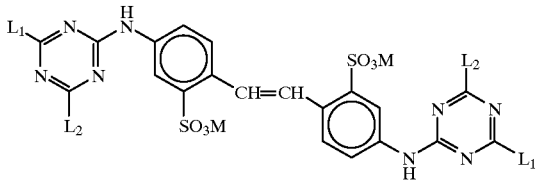

In formula (SR), each of $L_1$ and L2 which may be identical or different is a group $—OR_{11}$ or $—NR_{12}R_{13}$ wherein each of $R_{11}$, $R_{12}$ and $R_{13}$ is a hydrogen atom or alkyl group and satisfies at least one of the following requirements (1) and (2).

(1) $L_1$ and $L_2$ in formula (SR) have in total 4 substituents selected from the class of the following general formula (A).

(2) $L_1$ and L in formula (SR) have in total 24 substituents selected from formula class (A) and remaining substituents selected from formula class (B).

Formula class (A) includes: $—SO_3M$, $—OSO_3M$, —COOM, —NRR'R" X

Formula class (B) includes: —OH, $—NH_2$, —CN, $—NHCONH_2$

In formula class (A), X is a halogen atom and R, R', and R" are alkyl groups. In formula (SR) or (A), M is a hydrogen atom, alkaline earth metal, ammonium or pyridinium. The compound of formula (SR) is effective either when used alone or when used in combination with plural types of diaminostilbene compounds. For such combined use, the compound to be combined is preferably a compound of formula (SR) or a diaminostilbene compound of the following general formula (SR-c).

(SR-c)

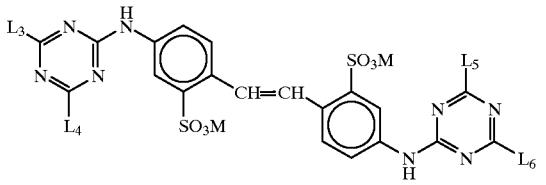

In formula (SR-c), each of $L_3$, $L_4$, $L_5$, and $L_6$ which may be identical or different is a group —$OR_{18}$ or —$NR_{19}R_{20}$ wherein each of $R_{18}$, $R_{19}$ and $R_{20}$ is a hydrogen atom or substituted or unsubstituted alkyl group. The brightening agent which is used in combination with the compound of formula (SR) may be selected from commercially available diaminostilbene brighteners. Such commercially available compounds are described in for example "Dyeing Note," 19th Ed., Senshoku-sha, pp. 165–168; T. Ruble "Optical Brighteners, Noyes Data Corp., (1972) and "Handbook Textilhilfsmittel", (1977) pp. 645–66. Among the products described therein, Blankophor REU and Tinapol SFP are preferred.

In practicing the invention, it is preferred that the color developer working solution and color developing replenisher be substantially free of benzyl alcohol from the standpoints of preventing precipitation from occurring in the replenisher and a variation of photographic properties from occurring with a variation of the quantity photosensitive material being processed. The term "substantially free" means a benzyl alcohol concentration of less than 2 ml/liter, more preferably less than 0.5 ml/liter. Most preferably, the replenisher or developer is free of benzyl alcohol.

The inventive slurry may be used at a processing temperature of 20 to 50° C., preferably 30 to 45° C. The developing time is in the range of 20 seconds to 5 minutes, preferably 30 seconds to 2 minutes. To minimize effluent and promote environmental protection, the amount of developer replenisher solution used is preferably reduced by various regenerating methods. Regeneration of the processing solution can be carried out while circulating the solution in an automatic processor. Alternatively, the processing solution can be taken out of the processing tank, regenerated by suitable treatment, and then fed back to the processing tank. In particular, the developer can be regenerated for reuse by removing contaminants and/or restoring necessary developer components. The used developer is regenerated by passing it through an anion exchange resin, effecting electric dialysis, or by adding a chemical composition known as a regenerating agent to it to increase its activity whereupon the solution is ready for reuse. The percent regeneration (which is given as the proportion of an overflow in overall replenisher solution) is preferably at least 50%, more preferably at least 70%. In the developer regeneration process, the developer overflow is regenerated and used as a replenisher. Anion exchange resin is preferably used here. Regarding the preferred composition of anion exchange resin and the regeneration of the resin itself, reference is made to Diaion Manual (1), 14th Ed. (1986) by Mitsubishi Chemical K.K. Preferred anion exchange resins are those of the composition described in U.S. Pat. No. 4,948,711 incorporated herein by reference. It is also recommended that an overflow is regenerated as a replenisher merely by adding a regenerating agent thereto without resorting to anion exchange or electric dialysis as in the method described in U.S. Pat. No. 5,147,766; incorporated herein by reference, because this method is quite simple.

The slurry is generally contained in a replenishing cartridge which may be made of any desired material such as paper, plastics and metals, preferably plastic materials having a coefficient of oxygen permeation of up to 50 ml/(m2)(atm)(day). The coefficient of oxygen permeation may be measured by the method described in N. J. Calyan, O2 permeation of plastic containers," Modern Packing, December 1968, pp. 143–145. Preferred plastic materials include polyvinylidene chloride (PVDC), nylon (NY), polyethylene (PE), polypropylene (PP), polyester (PES), ethylene-vinyl acetate copolymers (EVA), ethylene-vinyl alcohol copolymers (EVAL), polyacrylonitrile (PAN), polyvinyl alcohol (PVA), and polyethylene terephthalate (PET). Among these, PVDC, NY, PE, EVA, EVAL, and PET are preferred for the purpose of reducing oxygen permeability. These materials may be used alone and shaped into containers. Alternatively, they are shaped into films which are laminated in a proper combination (into a so called laminate or composite film). The container may take any desired shape including bottle, cubic and pillow shapes. Cubic type and analogous containers are preferred because they are flexible, easy to handle, and collapsible into a minimal volume after use. The composite film preferably has a thickness of about 5 to 1,500 (O.), more preferably about 10 to 1,000 (i). The container should preferably have an interior volume of about 100 ml to 20 liters, more preferably about 500 ml to 10 liters. The container or cartridge may be contained in an outer box of corrugated paper board or plastic material. Alternatively, the container or cartridge may be integrally formed with an outer shell. Cartridges with a low coefficient of oxygen permeation are particularly appropriate for the slurry developer.

EXAMPLES

Examples of the present invention are given below by way of illustration and not by way of limitation.

Example 1

A selection of compounds according to formula (1) as described in table 1. were evaluated for water miscibility, and specific p-phenylenediamine derivative: 4amino-3-methyl-N-ethyl-N-((beta)-(methanesulfonamido) ethyl) aniline free base (CD-3 FB) solubility. The results were compared to prior art and other non-inventive compounds. A "pass" notation signifies that the test compound was miscible with water and could dissolve at least 0.1 gm of CD-3 FB per liter of test solution at 25 C yielding a clear solution free from noticeable turbidity. All solutions contain 75% (w/w) of the test compound (1) and 25% water except where noted. This CD-3 FB solubility criteria was selected because stable, homogenous slurry developers could be prepared with such compounds. In contrast, slurry developers prepared with the comparative examples which failed the CD-3 FB solubility criteria showed marked phase separation, significant viscosity increase, and CD-3 FB precipitation when diluted with water. The results are summarized in Table 1.

TABLE 1

Solubility tests for CD-3 FB in selected examples of compound (I).

| Compound (I) "Inventive" Examples | Molecular Structure | Solubility Test Results | Miscibility with water |
|---|---|---|---|
| Ethylene glycol (EG) | I-1 | Pass | Pass |
| Diethylene glycol (DEG) | I-2 | Pass | Pass |
| Triethylene glycol (TEG) | I-3 | Pass | Pass |
| Polyethylene glycol 200 (about 4 EO units) | I-4 | Pass | Pass |
| 1,2-Propanediol | I-5 | Pass | Pass |
| 1,3-Butanediol | I-6 | Pass | Pass |
| DEG-monomethyl ether | I-7 | Pass | Pass |

TABLE 1-continued

Solubility tests for CD-3 FB in selected examples of compound (I).

| Compound (I) "Inventive" Examples | Molecular Structure | Solubility Test Results | Miscibility with water |
|---|---|---|---|
| 2-Ethoxyethanol | I-8 | Pass | Pass |
| n-Propanol | I-9 | Pass | Pass |
| TEG-Phenyl ether | I-10 | Pass | Pass |
| EG Acetate Mixture comprising: | | Pass | Pass |
| 52% EG-monoacetate | I-11 | | |
| 46% EG-diacetate | (not inventive) | | |
| 1.6% EG | I-1 | | |
| DEG + EG-acetate, 5:1 blend (w/w), no water added | I-2, 11 | Pass | Pass |
| DEG + DEG-(mono) methyl ether, 7:3 blend (w/w) | I-2, 7 | Pass | Pass |
| Comparative Examples: | | | |
| Glycerol | C-1 | Fail | Pass |
| Triethanolamine (TEA) | C-2 | Fail | Pass |
| EG diphenyl ether | C-3 | Pass | Fail |
| EG diethyl ether | C-4 | Pass | Fail |

Example 2

The suitability of diethylene glycol (inventive) and triethanolamine (comparative) in making a slurry developer was compared (see composition below, all raw materials are solids unless noted otherwise). The slurry developer was prepared using a Silverson model L4RTA high shear laboratory mixer equipped with a standard Emulsor screen with medium perforations (available from Silverson Machines Inc. (East Longmeadow, Mass.). The blend was continuously cooled in an ice water bath during processing so that the blend temperature never exceeded 40 C. The finished slurry developer was subjected to a cold storage test at 4 C for 3 days to confirm phase stability and CD-3 FB solubility after dilution and dissolution in water. At the conclusion of the test, the DEG slurry appeared homogeneous and flowable without noticeable sediment on warming to room temperature while the TEA slurry had hardened appreciably (caked), and further displayed substantial amounts of CD-3 FB precipitate on dilution with water.

TABLE 2

TEA and DEG blend composition and preparation.

| Component | Gm/1.5 kg. batch | mixing procedure |
|---|---|---|
| 1. a. TEA b. DEG | 651.5 | Components 1–5 were blended together at least 6000 rpm until sodium hydroxide dissolved as shown by a clear, turbidity free solution. |
| 2. Potassium bromide | 0.2 | |
| 3. Anionic surfactant (alkylaryl sulfonic acid, sodium salt derivative) | 1.3 | |
| 4. Nonionic surfactant (polyoxyethylene derivative) | 0.05 | |
| 5. Sodium hydroxide | 45.6 | |
| 6. EDTA, tetrasodium salt | 55.6 | Components 6 & 7 are added together to the mix and the mix is blended for 9100 rpm until homogenous. |
| 7. Potassium carbonate | 342.6 | |
| 8. Hydroxylamine N,N' diethanesulfonic acid | 61.2 | Components 8 & 9 are added together to the mix and the mix is blended at 9700 rpm until homogenous. |
| 9. Brightening agent | 32.6 | |
| 10. Disodium 4,5-dihydroxy-m-benzene-1,3-disulfonate | 6.5 | Components 10–12 are added together to the mix and the mix is blended at 9700 rpm until homogenous. |
| 11. Sodium sulfite | 3.9 | |
| 12. Sodium chloride | 13.0 | |
| 13. 4-Amino-3-methyl-N-ethyl-N-((beta)-methanesulfonamido) ethyl)aniline, Sulfuric acid salt, (CD-3) | 140.1 | Blended into the mix beginning at 4000 rpm and gradually increased to 7000 rpm until homogenous. |
| 14. Water | 130.4 | Added to the mix and blended at 10,000 rpm until homogenous. |
| 15. Water soluble liquid silicone surfactant derivative | 2.6 | Components 15 & 16 are added together to the mix and the mix is blended at 5000 rpm until homogenous. |
| 16. Polystyrene sulfonate-maleic acid copolymer | 13.0 | |

Note: EDTA is ethylenediamine tetraacetic acid

Example 3

Effect of elevated temperature storage of a slurry developer containing diethylene glycol on photographic sensitometric performance.

A slurry developer was formulated as described below and subjected to 4 week aging tests at 22 C and 50 C. At the conclusion of the aging period, the slurry developers were diluted with, and dissolved in tap water in the ratio of 1 liter of slurry to 9 liters of water. Sensitometric tests were performed using available commercially pre-exposed control strips and exposed continuous wedge strips made from Eastman Kodak Edge and Royal, Fuji Super FA5 Type 5, Mitsubishi SA B220-F, and Agfa Type 10 color print papers.

TABLE 3a

Photographic process conditions used:

| tank | time (sec) | temperature (F.) | product |
|---|---|---|---|
| Development | 45 | 100 | working solution prepared from DEG slurry developer, pH = 10.1 |
| Bleach Fix: | 45 | 100 | Fuji Hunt RA |
| Stabilizer | 30 | 100 | Fuji Hunt Superflo |
| Stabilizer | 30 | 100 | Fuji Hunt Superflo |
| Stabilizer | 30 | 100 | Fuji Hunt Superflo |

Characteristic curves were measured on the continuous wedge strips. D(min), D(max), HD, LD, and gamma were measured and compared with Fuji Hunt EC RA LR developer as the reference. No significant differences in sensitometric performance was observed among the 22 C and 50 C stored samples, freshly prepared slurry developer, and the reference developer.

The following represents the composition and method of preparation of the DEG slurry developer used in the aging study (all raw materials are solids unless noted otherwise). A 5 liter batch size was prepared sufficient to make 50 liters of developer working solution. A Charles Ross and Sons model ME100LX homogenizer with a fixed speed of 4850 rpm was employed. Continuous cooling with approx. 4 C tap water was used throughout such that the mix temperature never exceeded 40 C during preparation:

TABLE 3b

DEG blend composition and preparation.

| Component | Gms/ 6.35 kg batch | Mixing Procedure |
|---|---|---|
| 1 DEG | 3,000 | Components 1–4 were mixed until dissolved (approx. 10 min) forming a hazy clear solution |
| 2 Potassium bromide | 0.5 | |
| 3 Sodium chloride | 50 | |
| 4 Sodium hydroxide beads | 148.5 | |
| 5 Tetrasodium EDTA-2 hydrate | 213.5 | Add components 5 & 6 and mix until uniformly dispersed. |
| 6 Potassium carbonate | 1315 | |
| 7 Hydroxylamine N,N' diethanesulfonic acid | 267 | Add components 7 & 8 and mix until uniformly dispersed |
| 8 Brightening agent | 125 | |
| 9 Disodium 4,5-dihydroxy-m-benzene-1,3-disulfonate | 25 | Add components 9 & 10 and mix until uniformly dispersed |
| 10 Sodium sulfite | 15 | |
| 11 CD-3 | 537.5 | Cool mix to 22 C. before adding component 11. Then mix until uniformly dispersed |
| 12 Water soluble liquid silicone surfactant | 10 | Add components 12 & 13 and mix until uniformly dispersed |
| 13 p-Isononylphenoxy-polyglycidol | 2 | |
| 14 Water | 570 | Add component 14 and mix until uniformly dispersed |
| 15 Anionic surfactant (alkylaryl sulfonic acid, sodium salt derivative) | 5 | Add components 15–17 and mix until uniformly dispersed |
| 16 Nonionic surfactant (polyoxyethylene derivative) | 0.2 | |
| 17 p-Toluenesulfonic Acid hydrate | 50 | |

Example 4

The effects on CD-3 stability upon dilution of the slurry with respect to (a) the presence and absence of compound 1; (b) high and low water content; (c) slurry component addition order; and (d) working strength pH are examined as summarized in table 4A below:

| Example | Parameter | Description |
|---|---|---|
| 4(a) | The presence and absence of compound I | The effect of EG (PE-1: inventive) versus glycerol (PE-3: comparative) is examined. |

-continued

| Example | Parameter | Description |
|---|---|---|
| 4(b) | High and low water content | The effect of low water content i.e. approx. 2.0.% (w/w) (PE-1: inventive) vs. high water content i.e. 66.0% (w/w) (PE-2: comparative) is examined. |
| 4(c) | Slurry component addition order | The effect of addition order i.e. either adding substantial amounts of water before (PE-1: inventive) or after (PE-1': comparative) dispersing the solid alkaline compounds and solid CD-3 into ethylene glycol is examined. |
| 4(d) | Working strength pH. | The effect of the final working strength pH is examined (PE-1: pH 11.25, inventive vs. PE-4: pH 12.22, comparative according to Hashimoto). |

Dissolution tests were done by diluting 124 gms of slurry to make 1 liter of solution (vol. dilution factor of 10) at 22–23 C with deionized water. Diluted solutions were kept exposed to the air overnight and observed the next day for evidence of CD-3 FB precipitate or oxidation products. A "pass" notation means that a clear, turbidity free solution resulted. A "fail" notation means that a CD-3 FB derivative precipitated. The results are summarized in table 4B below.

TABLE 4

INVENTIVE/COMPARATIVE TEST RESULTS

| Ex. | Test Description | Inventive/ Comparative | Sample No. | Dissolution Test | pH of diluted solution |
|---|---|---|---|---|---|
| 4(a) | Compound I effect | Inventive | PE-1 | Pass | 11.25 |
| | | Comparative | PE-3 | Fail | 11.44 |
| 4(b) | Water effect | Inventive | PE-1 | Pass | 11.25 |
| | | Comparative | PE-2 | Fail | — |
| 4(c) | Addition order effect | Inventive | PE-1 | Pass | 11.25 |
| | | Comparative | PE-1' | Fail | 11.70 to 11.40 |
| 4(d) | pH effect | Inventive | PE-1 | Pass | 11.25 |
| | | Comparative | PE-4 | Pass | 12.22 |

In example 4(a) comparative glycerol fails to prevent CD-3 FB derivative precipitation while inventive EG prevents precipitation. In example 4(b) a water content in excess of the inventive limitation of 50% (w/w) similarly fails to prevent precipitation while a lower water content under 50% prevents precipitation. In example 4(c) the addition of water in excess of 5% (w/w) prior to the addition of inventive EG causes precipitation while the addition of the same amount of water after the blending of EG, alkaline compounds, and CD-3 does not cause precipitation. Lastly, in example 4(d), the effect of high pH after dilution i.e. a pH of greater than 12.0 and the absence of compound I (according to Hashimoto) is also seen to prevent CD-3 precipitation which is equivalent to the inventive case where the pH is under 12.0 and EG is present.

Description of PE-1 to PE4 Test Slurries:

All slurry components are solids unless noted otherwise. Slurry PE-1' is identical to PE-1 with the exception that the order of addition of the Phosphonate Chelate solution and EG are interchanged. Percentages of water content are also provided. Each compound listed is sequentially added in the order listed, and blended using a Silverson model L4RTA high shear laboratory mixer equipped with a standard Emul sor screen with medium perforations until the blend is homogenous. See table 4C below:

TABLE 4C

FORMULATION SUMMARY

| Formula Name | PE-1 | PE-2 | PE-3 | PE-4 |
|---|---|---|---|---|
| EG or GLYCEROL | 70 gm (EG) | 70 gm (EG) | 70 gm (GLYCEROL) | 70 gm (GLYCEROL) |
| Diethyl-hydroxylamine liq. | 4.00 gm. | 4.00 gm | 4.00 gm | 4.00 gm |
| Sodium Hydroxide | 4.08 gm | 4.08 gm | 5.00 gm | 5.15 gm |
| Potassium Carbonate | 24.00 gm | 24.00 gm | 24.00 gm | 24.00 gm |
| Sodium Sulfite | 0.30 gm | 0.30 gm | 0.30 gm | 0.30 gm |
| EDTA | 1.0 gm | 1.0 gm | 1.0 gm | 1.0 gm |
| Tinopal SFP | 3.0 gm | 3.0 gm | 3.0 gm | 3.0 gm |
| CD-3 | 11.25 gm | 11.25 gm | 11.25 gm | 11.25 gm |
| Phosphonate Chelate (43% aqueous soln.) | 5.31 gm | 5.31 gm | 5.31 gm | 5.31 gm |
| Deionized Water | — | 236 gm | | |
| Water % (w/w) | 1.8 | 66.0 | 1.8 | 1.8 |
| pH of diluted slurry. | 11.25 | — | 11.44 | 12.22 |

Benefits of the Invention

There has been described a homogeneous, slurry-form single part color photographic developer composition which is diluted and dissolved in water to make a working strength developer or developer replenisher. In one embodiment, the slurry has sufficient fluidity to flow out of a container merely when the container is decanted. In another embodiment, the slurry can be easily transferred from the container into a photographic processor via a pump. The slurry is easy to formulate, highly stable, and simple to use while at the same time minimizing the possibility of user formulation errors. As compared with conventional liquid concentrates and ready-to-use solutions, the slurry has reduced volume and weight, which contributes to substantial savings in transportation cost and storage space. The reduced volume of the required containers and the reduced quantity of resinous material to form the containers is not only economical, but is also advantageous with regard to environmental protection because of a corresponding lower burden for the collection and disposal of used containers. Due to its excellent solubility, the slurry composition will produce high quality photographs without suffering from the problems of insoluble matter adhering to the photographic emulsion, and the interior surfaces of the photographic processor. During long-term storage, the slurry remains homogenous and stable, without signs of solidification, or p-phenylenediamine free base precipitation upon dissolution to make a working strength developer or developer replenisher. While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A method for making a homogeneous, single-part slurry color developer, comprising: dispersing one or more solid alkaline compounds and one or more solid p-phenylenediamine derivatives into a compatible water miscible organic solvent whichcontains substantially no water; and blending a compound represented by Formula (I) into the solvent-alkali-p-phenylenediamine derivative mixture (I)

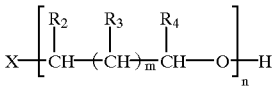

where X is selected from the group consisting of —$OR_1$, H and methyl; $R_1$ is selected from the group consisting of H, acyl, alkyl, alkenyl, aryl, and heteroaromatic, which is either unsubstituted or substituted; $R_2$ and $R_4$ can be the same or different and are selected from the group consisting of H, alkyl, alkenyl, aryl, and heteroaromatic, which is either unsubstituted or substituted; $R_3$ is selected from the group consisting of H, alkoxyl, alkyl, aryl, arylalkoxyl, aryloxycarbonyl, and alkoxycarbonyl, which is either unsubstituted or substituted; n is an integer from 1 to 5; m is 0 or 1.

2. The method of claim 1 wherein the alkaline compounds are selected from the group consisting of alkali metal hydroxides and alkali metal carbonates.

3. The method of claim 1 wherein the resulting mixture is then dispersed in water whereby the resulting slurry contains water in a concentration of less than about 50% (w/w).

4. The method of claim 3 wherein a dispersing agent is added and is present in the slurry with the water.

5. A method for making a homogeneous, single-part slurry color developer, comprising: dispersing one or more solid alkaline compounds and one or more solid p-phenylenediamine derivatives into a compound represented by Formula (I) which contains substantially no water (I)

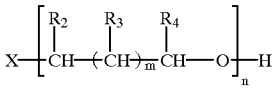

where X is selected from the group consisting of —$OR_1$, H and methyl; $R_1$ is selected from the group consisting of H, acyl, alkyl, alkenyl, aryl, and heteroaromatic, which is either unsubstituted or substituted; $R_2$ and $R_4$ can be the same or different and are selected from the group consisting of H, alkyl, alkenyl, aryl, and heteroaromatic, which is either unsubstituted or substituted; $R_3$ is selected from the group consisting of H, alkoxyl, alky, aryl, arylalkoxyl, aryloxycarbonyl, and alkoxycarbonyl, which is either unsubstituted or substituted; n is an integer from 1 to 5; m is 0 or 1.

6. The method of claim 5 wherein the alkaline compounds are selected from the group consisting of alkali metal hydroxides and alkali metal carbonates.

7. The method of claim 5 wherein the resulting dispersion of one or more alkaline compounds, one or more solid p-phenylene derivatives and the compound of Formula (I) is then dispersed in water whereby the resulting slurry contains water in a concentration of less than about 50% (w/w).

8. The method of claim 7 wherein a dispersing agent is added and is present in the slurry with the water.

* * * * *